United States Patent [19]

Gibson

[11] 4,306,959

[45] Dec. 22, 1981

[54] USE OF CHELATING AGENTS IN THE CONVERSION OF COAL TO LOW MINERAL CONTENT FUEL

[75] Inventor: William G. Gibson, New Eagle, Pa.

[73] Assignee: Conoco Inc., Stamford, Conn.

[21] Appl. No.: 120,019

[22] Filed: Feb. 11, 1980

Related U.S. Application Data

[63] Continuation of Ser. No. 899,623, Apr. 24, 1978, now Defensive Publication No. T978,004.

[51] Int. Cl.[3] ..... C10G 1/00; C10G 29/00; C10G 21/12; C10G 21/16

[52] U.S. Cl. ..... 208/8 LE; 208/289; 208/290; 208/291

[58] Field of Search ..... 208/8 LE, 289, 290, 208/291

[56] References Cited

U.S. PATENT DOCUMENTS

| | | | |
|---|---|---|---|
| 2,523,549 | 9/1950 | Axe | 208/289 X |
| 2,568,583 | 9/1951 | Granes | 208/289 X |
| 3,164,546 | 1/1965 | Millikan et al. | 208/289 X |
| 3,617,530 | 11/1971 | Rieve et al. | 208/289 X |

*Primary Examiner*—Curtis R. Davis
*Assistant Examiner*—William G. Wright
*Attorney, Agent, or Firm*—William A. Mikesell, Jr.; F. Lindsey Scott

[57] ABSTRACT

An improvement in the production of low mineral content fuel by coal liquefaction processes which yield as a primary product a mixture of liquid and solids a part of which are suspended in the liquid whereby the separation of the suspended solids is facilitated by the addition of an effective amount of a suitable chelating agent to the mixture. The chelating agent is optionally added as a solution of the chelating agent in a suitable solvent and desirably is present in an amount from about 100 to about 150% of the stoichiometric amount required to react with the suspended solids in the mixture.

8 Claims, No Drawings

USE OF CHELATING AGENTS IN THE CONVERSION OF COAL TO LOW MINERAL CONTENT FUEL

This is a continuation, of application Ser. No. 899,623, filed Apr. 24, 1978, Defensive Publication No. T978,004.

This invention relates to processes for the conversion of coal to a clean fuel, i.e. a fuel which is substantially free of mineral components normally found in coal.

In particular, the invention relates to coal liquefaction processes wherein a solvent (herein after sometimes called liquefaction solvent) is present during the liquefaction of coal. Liquefaction may be achieved by hydrogenation, depolymerization, extraction, etc. The liquefaction solvent, which is generally coal-derived, may function as a solvent for the coal, the products, or both. It may also play a reactive role, for instance, in the depolymerization of the coal molecules. Examples of such coal liquefaction processes are described in U.S. Pat. Nos. 3,018,242; 3,117,921; 3,143,489; 3,158,561; 3,523,886; Re. 25,770; and 3,321,393.

The primary product of such coal liquefaction processes is a mixture of liquid and undissolved solids. Some gas is generally also produced. The liquid is a solution of coal liquefaction products dissolved in the liquefaction solvent. Most of the undissolved solids may be readily separated from the liquid by conventional solids-liquids separation processes such as filtration, centrifugation, sedimentation, hydroclones, etc. However, a part of the undissolved solids (the amount being a function of the particular coal and the particular liquefaction treatment) appears as extremely finely divided particles on the order of ten microns or less in size. These particles are rich in mineral matter normally found in all coals. Upon combustion of the fuel which contains them, they form ash.

Complete separation of such finely divided particles from the liquid in which they are suspended cannot be accomplished by the usual mechanical separation techniques at ordinary temperatures (i.e. by filtration, centrifugation, settling, or hydroclones) because of the extremely fine state of subdivision of the solid particles and because of the high viscosity of the liquid. Separation is improved by operation at elevated temperatures due to a rapid decrease in liquid viscosity, as well as an increase in the density differential between liquid and solid. Even at these elevated temperatures and reduced viscosities, the conventional separation techniques may be only partially effective.

The prior art offers many solutions to the problem of separation of described above. Some of the pertinent disclosures relate to the use of a precipitating solvent (sometimes called an anti-solvent) to effect agglomeration of the finely divided solids, thereby permitting use of conventional solids-liquid separation techniques. Illustrative of prior art pertinent to such agglomeration techniques are the following U.S. Pat. Nos. 2,060,447; 2,631,982; 2,774,716; 2,871,181; 2,964,460; 2,989,458; 3,010,893; 3,018,241; 3,275,546; 3,519,553; 3,607,716; 3,607,717; 3,607,718; 3,607,719; 3,635,814; 3,642,608; 3,687,837; and 3,791,956. A primary objective of the present invention is the maximum recovery of a fuel product which is substantially free of mineral matter with a minimal load imposed upon the distillate recovery equipment which separates the liquefaction solvent and precipitating solvent from the low mineral content coal-derived fuel. In such processes heretofore separation techniques as described above have been used with the mixture produced in coal liquefaction processes either with or without the use of precipitating solvents.

It is proposed by the improvement of the present invention to add chelating agents to such liquid mixtures thereby facilitating the separation of suspended solids from such mixtures. When the mixture is of a sufficiently low viscosity to permit settling at a reasonable rate without the addition of a precipitating solvent the chelating agent can be added directly and separation accomplished by filtration, centrifugation, settling or hydroclones. The use of precipitating solvents also aids in causing the suspended solids to be precipitated from the mixture. Chelating agents are also proposed for use in mixtures which include precipitating solvent.

While the chelating agent may be added directly to the mixture, desirably, the chelating agent is added as a solution of the chelating agent in a suitable solvent such as toluene, methylethyl ketone, alcohols or the like. Such is desirable since it lends itself more readily to the addition of the chelating agent by automatically controlled systems and further since it permits more accurate control of the amount of the chelating agent used. While lesser amounts may be used, desirably the chelating agent is added in an amount equal to at least 75% of the stoichiometric amount required to react with the solids in the mixture. The stoichiometric amount is best determined by an experimental evaluation of each mixture involved. Those skilled in the art can readily determine the amount of chelating agent to be used by determining a quantity which is sufficient to precipitate substantially all the suspended solids but beyond which further quantities of chelating agent serve no beneficial purpose. While the determination of the stoichiometric amount may be less sharply defined than with conventional chemical reactions, it is believed that those skilled in the art will find no difficulty in determining an effective amount as set forth above. Preferably the amount added should be from about 100 to about 150% of the amount required to react with substantially all of the suspended solids in the mixture.

As is well known to those skilled in the art, elation is the formation of a heterocyclic ring containing a metal ion, with the metal ion being attached by coordinate links to two or more non-metal atoms in the same molecule. One important property of chelation is found in the fact that it brings about an increase in the stability of the bond between a metal atom and a coordinating group that forms the chelate ring. For instance, monamines are much poorer coordinators than ammonia while complexes of the bidentate (literally "two toothed" or "two clawed") ethylenediamine many times more stable than those of ammonia.(1)

[1]The Encyclopedia of Chemistry, Third Edition, Edited by Clifford A. Hampel, Gessner G. Hawley, Van Nostrand Reinhold Company, 1973.

Chelating agents can be classified as bidentate ligands, such acetylacetone and ethylenediamine or multidentate ligands. A representative list of some common multidentate ligands is shown in the following Table.(2)

[2]Douglas, Bodie E., McDaniel, Darl H., *Concepts and Models of Inorganic Chemistry, Blaisdell Publishing Company,* 1965.

TABLE

Some Common Multidentate Ligands

| Name | Formula | Abbreviation | Classification |
|---|---|---|---|
| Carbonato | $CO_3^{2-}$ | | Bidentate |
| Oxalato | $C_2O_4^{2-}$ | ox | Bidentate |
| Ethylenediamine | $NH_2C_2H_4NH_2$ | en | Bidentate |
| 1,2-Propanediamine | $NH_2CH(CH_3)CH_2NH_2$ | pn | Bidentate |
| Acetylacetonato | $CH_3-\overset{O-}{\overset{\vert}{C}}=\overset{O}{\overset{\Vert}{C}}H-CH_3$ | acac | Bidentate |
| 8-Hydroxyquinolinato | 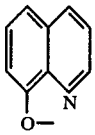 | oxine | Bidentate |
| 2,2'-Dipyridyl | 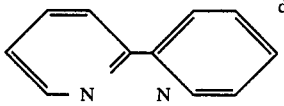 | dipy | Bidentate |
| 1,10-Phenanthroline | 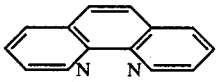 | phen | Bidentate |
| Clycinato | $NH_2CH_2CO_2-$ | gly | Bidentate |
| Diethylenetriamine | $NH(C_2H_4NH_2)_2$ | dien | Tridentate |
| Triethylenetetramine | $(-CH_2NH_2C_2H_4NH_2)_2$ | trien | Quadridentate |
| Nitrilotriacetato | $N(CH_2CO_2)_3^{3-}$ | NTA | Quadridentate |
| Tetraethylenepentamine | $NH(C_2H_4NHC_2H_4NH_2)_2$ | tetraen | Quinquidentate |
| Ethylendiamine-tetraacetato | $[-CH_2N(CH_2CO_2)_2]_2^{4-}$ | EDTA | Sexadentate |

Of the chelating agents shown, EDTA and sodium oxalate are preferred and it is also preferred that the chelating agent be added to the mixture after the coal liquefaction process is substantially complete and the material has been removed from the coal liquefaction vessel. Chelating agents may also be effective in coal pre-treatment or in the liquefaction vessel, but the primary emphasis of the present invention is directed to the use of chelating agents in the solids separation zone.

A coarse solids or heavy solids removal step can be used prior to the addition of the chelating agent if desired. In many instances, heavier, suspended, undissolved solids are readily removed without the necessity for the addition of chelating agents, precipitating solvents or the like. Normally the smaller suspended solids remain in the mixture as noted for instance in U.S. Pat. No. 3,791,956. It is the removal of these small suspended solids to which present invention is directed.

Having thus described the present invention by reference to certain of its preferred embodiments, it is pointed out that many variations and modifications are possible within the scope of the present invention, and it is anticipated that many such variations and modifications may appear obvious or desirable to those skilled in the art upon a review of the foregoing description are preferred embodiments.

Having thus described the invention I claim:

1. In a process for producing a low mineral content fuel by coal liquefaction processes which yield as a primary product a mixture of liquids and solids, the improvement comprising; admixing an effective amount of a suitable chelating agent with said mixture thereby facilitating the separation of said solids from said mixture.

2. The improvement of claim 1 wherein a precipitating solvent is mixed with said mixture to facilitate the separation of said solids from said mixture.

3. The improvement of claim 1 wherein said mixture comprises a solution of liquid product in a liquefaction solvent.

4. The improvement of claim 1 wherein said chelating agent is added as a solution of said chelating agent in a suitable solvent.

5. The improvement of claim 1 wherein said chelating agent is added in an amount equal to at least 75% of the amount required to react with said solids in said mixture.

6. The improvement of claim 1 wherein said added amount is from about 100 to about 150% of the amount required to react with said solids in said mixture.

7. The improvement of claim 1 wherein said chelating agent is added to said liquefaction zone.

8. The improvement of claim 1 wherein said chelating agent is added to said coal in the pre-treatment of said coal prior to charging said coal to said liquefaction zone.

* * * * *